US005505370A

United States Patent [19]

Brown et al.

[11] Patent Number: 5,505,370

[45] Date of Patent: Apr. 9, 1996

[54] CARTON HAVING SEPARATE COMPARTMENTS

[75] Inventors: Arnold Brown, Owings Mills; Gregory A. Lathrop, Manchester; David F. Gnadt, Owings Mills; Kara E. Sturdy, Reisterstown, all of Md.

[73] Assignee: Lever Brothers Company, Division of Conopco, Inc., New York, N.Y.

[21] Appl. No.: 364,577

[22] Filed: Dec. 27, 1994

[51] Int. Cl.[6] ..... B65D 5/54; B65D 5/63

[52] U.S. Cl. ..... 229/120.011; 229/120.02; 229/208; 229/245; 493/128; 493/150

[58] Field of Search ..... 229/120.01, 120.03, 229/120.011, 208, 245; 493/128, 130, 131, 132, 150, 151

[56] References Cited

U.S. PATENT DOCUMENTS

| | | | |
|---|---|---|---|
| 1,815,565 | 7/1931 | Hill et al. . | |
| 1,898,231 | 2/1933 | Weiss . | |
| 1,899,772 | 2/1933 | Richardson | 229/120.011 |
| 2,259,822 | 10/1941 | Kienlen . | |
| 2,442,699 | 6/1948 | Locke, Jr. . | |
| 2,697,544 | 12/1954 | Morand . | |
| 2,828,060 | 3/1958 | Brown . | |
| 2,852,180 | 9/1958 | Inman . | |
| 2,881,968 | 4/1959 | Inman . | |
| 2,884,180 | 4/1959 | Inman . | |
| 2,936,104 | 5/1960 | De Blaere . | |
| 2,992,767 | 7/1961 | Inman . | |
| 2,998,179 | 8/1961 | Zilles . | |
| 3,015,432 | 1/1962 | Tyrseck . | |
| 3,049,279 | 8/1962 | Mairs et al. . | |
| 3,092,301 | 6/1963 | Selle . | |
| 3,113,713 | 12/1963 | Green . | |
| 3,135,457 | 6/1964 | Risucci . | |
| 3,144,195 | 8/1964 | Hennessey | 229/208 |
| 3,166,229 | 1/1965 | Sherman et al. . | |
| 3,182,887 | 5/1965 | Larson . | |
| 3,261,536 | 7/1966 | Bixler . | |
| 3,295,743 | 1/1967 | Redpath et al. . | |
| 3,491,937 | 1/1970 | Brastad . | |
| 3,510,046 | 5/1970 | Reiner . | |
| 3,719,317 | 3/1973 | Brastad . | |
| 3,885,732 | 5/1975 | Foster | 229/208 |
| 4,003,516 | 1/1977 | Commerford et al. | 229/208 |
| 4,124,161 | 11/1978 | Meyers . | |
| 4,179,061 | 12/1979 | Gilbert . | |
| 4,398,661 | 8/1983 | Schillinger . | |
| 4,487,311 | 12/1984 | Lavery . | |
| 4,487,358 | 12/1984 | Ambrose . | |
| 4,533,052 | 8/1985 | Fruchey et al. | 229/120.011 |
| 4,651,918 | 3/1987 | Moore et al. . | |
| 4,793,494 | 12/1988 | Gordon, Jr. | 229/120.011 |
| 4,826,016 | 5/1989 | Foster . | |
| 4,909,433 | 3/1990 | Taylor | 229/120.011 |
| 4,913,291 | 4/1990 | Schuster | 229/120.011 |
| 5,048,690 | 9/1991 | Zimmerman . | |
| 5,135,158 | 8/1992 | Boyle et al. | 229/120.03 |
| 5,284,291 | 2/1994 | Sellors | 229/120.03 |

*Primary Examiner*—Gary E. Elkins
*Attorney, Agent, or Firm*—Gerard J. McGowan, Jr.

[57] ABSTRACT

A multi-carton package especially useful for household products such as soap bars. The package may be readily divided by the consumer into separate cartons. The cartons include delamination windows and easy opening tabs.

16 Claims, 4 Drawing Sheets

CARTON HAVING SEPARATE COMPARTMENTS

BACKGROUND OF THE INVENTION

Although soap bars are typically sold in individual cartons, manufacturers sometimes desire to promote the sale of two bars together. This is desirable not just for the manufacturer, but it is also more convenient for the consumer when he or she wishes to purchase two or more bars at the same time.

The most common way to sell two bars of soap together, is to pack the bars in individual cartons and tape the cartons together. However, the use of tape entails additional materials, costs, and processing expense. Moreover, the tape sometimes obscures or renders less attractive the graphics on the carton. Or, where the tape is adhered prior to the printing of the graphics, the appearance of the graphics suffers as the tape is not as receptive to graphics printing as the panels of the carton.

Where soap bars and other household products are sold in twos, or other multiples, it is sometimes desirable to permit the consumer to separate readily the two compartments into separate cartons. Therefore, an advantageous feature in some cases for a multi-compartment carton is ready separability.

Another desirable feature is that the cartons be readily opened. Modern packaging's focus on preventing premature exposure of the product by premature carton opening should not result in a carton which is impenetrable, especially to particular groups such as the elderly.

Risucci, U.S. Pat. No. 3,135,457, especially FIGS. 8–12, is directed to a carton having multiple compartments which are made from separable units.

Zilles, U.S. Pat. No. 2,998,179 is directed to a multi-compartment carton having a rib separating the compartments. A flange extends from the rib and is adhered to one inside panel of the carton. An end of a second panel is adhered to the outside of a third panel.

It is believed that a product is sold by Borden Foods called "Mrs. Grass Soup" which is packaged in a multi-compartment carton. The package is perforated in the center of the carton and uses the manufacturer's glue joint as a partition.

Nerds Candy manufactured by Willy Wonka is believed to employ a carton similar to the Mrs. Grass Soup carton.

Weiss, U.S. Pat. No. 1,898,231 illustrates a multi-compartment carton having a partition with an attaching flap 15 and attaching wall 16 which is continuous with a side wall of the carton.

Morand, U.S. Pat. No. 2,697,544 discloses a plural compartment box formed from a single blank of sheet material.

Other patents relating to multiple compartment cartons include U.S. Pat. Nos. 1,815,565, 2,442,699, 3,049,279, 3,092,301, 3,166,229, 3,510,046, 4,179,061, 4,398,661, 4,487,311, 4,487,358, 4,651,918, 4,826,016 and 5,048,690.

Meyers, U.S. Pat. No. 4,124,161 discloses that when sealing gases are applied to the top of underlying closure flaps, the flaps tend to droop, which interferes with sealing. Meyers makes a partial cut score along substantially the entire length of the top of the underlying flaps indented from the fold lines of the flaps to provide sealing margins. The partial cut scores may be in the form of a straight line or in sin wave or other non-linear shapes shown in Meyers' FIG. 5. The non-linear score lines are said to be stronger than the straight score lines.

Redpath et al., U.S. Pat. No. 3,295,743 discloses a carton having a zig-zag cut score line 31 extending across the front panel. Spots of adhesive are located between the zig-zag cut score line 31 and the upper edge of the front wall when the carton is glued in tubular form. The arrangement is said to permit the outer surface of the panel to peel off readily when the carton is opened if the adhesive is bonded sufficiently not to come loose when the carton is opened.

Patents disclosing weakened portions defined by scores or cuts include Brown, U.S. Pat. No. 2,828,060, Tyrseck, U.S. Pat. No. 3,01 5,432, Brastad, U.S. Pat. Nos. 3,491,937 and 3,719,317, and Kienlen, U.S. Pat. No. 2,259,822. Other cartons are disclosed in U.S. Pat. Nos. 2,852,180, 2,881,968, 2,884,180, 2,936,104 and 2,992,767.

Bixler, U.S. Pat. No. 3,261,536 discloses a carton having a delamination portion on a flap. De Blaere, U.S. Pat. No. 2,936,104 discloses a slit 40 which extends only partially through the carton structure forming the front wall and provides a weakened outer surface area to aid in the opening of the carton and to prevent peeling of the front wall when the carton is opened. Larson, U.S. Pat. No. 3,182,887 discloses a carton having a delaminating portion. Green, U.S. Pat. No. 3,113,713 discloses a carton having unprinted triangular areas 56.

SUMMARY OF THE INVENTION

The present invention is a package comprising at least two detachable cartons. The package of the invention is preferably formed from a single integral blank and the two detachable cartons share a top panel having a line of weakness through which the cartons may be separated. Each of the two cartons includes a lateral side panel, a bottom panel and a medial side panel and a glue flap extending from the medial side panel. Each of the glue flaps is adhered to a respective portion of the top panel. The cartons include front and rear opening flaps. Preferably the front opening flaps include lift tabs.

Advantageously, the front opening flaps include means to facilitate opening of the carton. In particular, it is preferred that the front outside or inside major flap include a delamination window, preferably one which is not formed by substantially straight lines in a direction parallel to the fold line separating the flap from the panel of the carton. The boundary of the delamination window typically is defined at least in part by a partial cut in the surface of the flap which is adhered to a surface of an overlying or underlying major flap. When any force is exerted on the flap, the flap containing the delamination window delaminates and the carton opens readily.

By forming the delamination window so that it does not include a straight line in a direction generally parallel to the fold line separating the window-containing flap from the panel, processing problems are avoided since straight lines on flaps parallel to fold lines can undesirably cause bending in the flap.

The design of the carton eliminates or at least substantially reduces the need for tape, thereby conserving the tape and improving the printing of graphics on the carton. The carton of the invention utilizes the materials of the blank very efficiently. The carton also admits of ready separation of the compartments and facile opening of the carton flaps for access to product.

For a more complete understanding of the above and other features and advantages of the invention, reference should be made to the following detailed description of preferred embodiments and to the accompanying drawings.

DETAILED DESCRIPTION OF THE INVENTION

Figure 1:
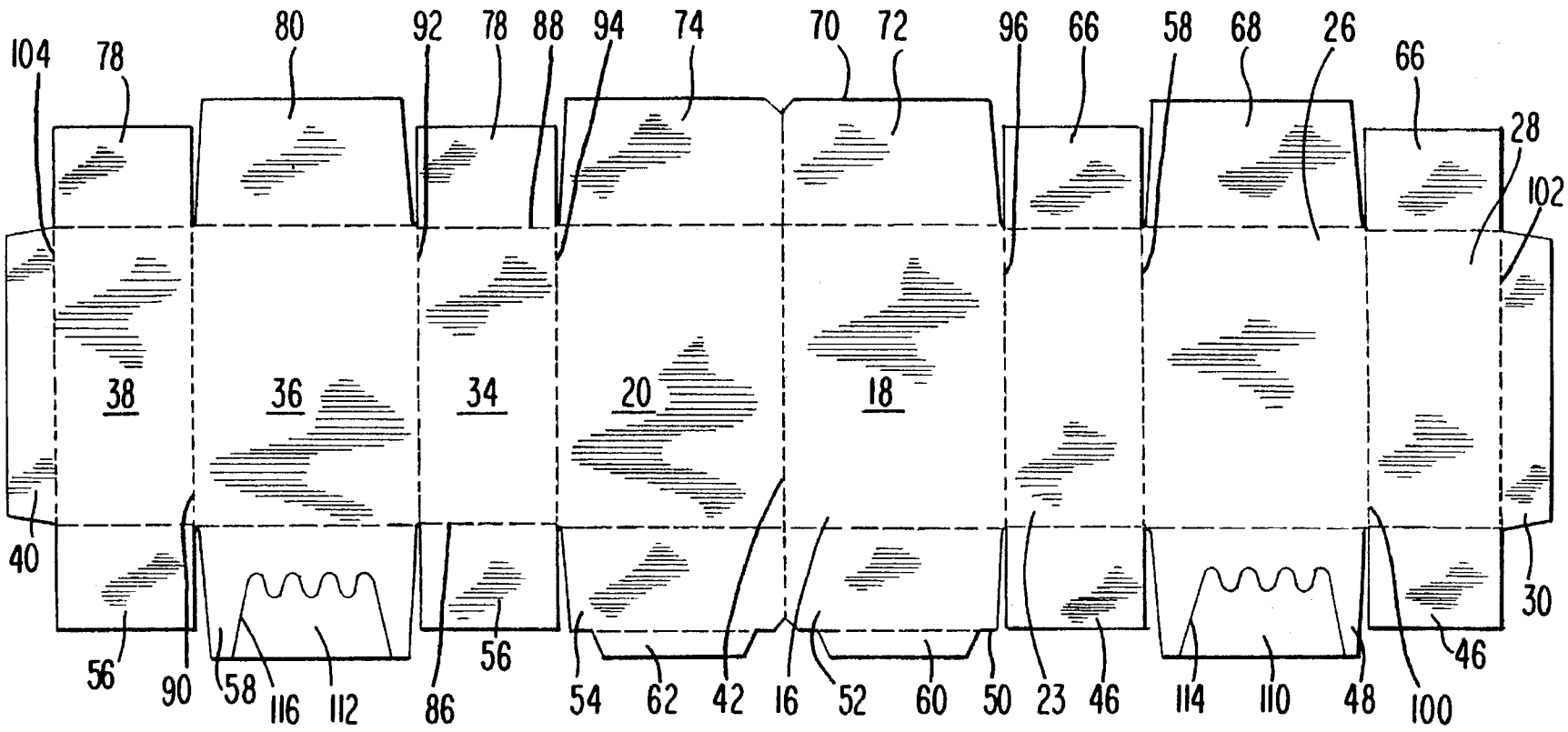
FIG. 1 is a top plan view of a blank used to construct the package of the invention.

The package 10 (FIGS. 2–4) comprises a first carton 12 and a second carton 14. The first carton 12 comprises top panel 16 which includes adjacent top subpanels 18 and 20, first lateral side panel 23, first bottom panel 26, and first medial side panel 28. First glue flap 30 extends from panel 28 and is adhered to the underside of first top subpanel 18.

Second carton 14 comprises second top subpanel 20, second lateral side panel 34, second bottom panel 36, and second medial side panel 38. Second glue flap 40 extends from second medial panel 38 and is adhered to the bottom of second top subpanel 20. Perforated cut line 42 separates first top subpanel 18 from second top subpanel 20.

The front closures of the cartons comprise first pair 46, 66 of minor flaps, inner major flap 48 and outer major flap 50 which comprises first major outer subflap 52 and second major outer subflap 54. Flap 46 attached to panel 28 is not shown in FIG. 4 for the sake of clarity. Subflaps 52 and 54 are separated by perforated line 42. The closure flaps for the second carton comprise second pair of front minor flaps 56 (flap 56 attached to panel 38 not shown in FIG. 4), inner major flap 58, and outer major subflap 54 mentioned previously.

Outer major subflaps 52 and 54 include lift tabs 60 and 62 respectively to facilitate lifting of the flaps to open the cartons.

The rear closure of the, carton 12 comprises first pair of rear closure minor flaps 66, first inner rear major flap 68 and outer major rear flap 70. Flap 70 is comprised of first outer major rear subflap 72 and second outer rear major subflap 74 separated by perforated line 42.

The rear closure flaps for second carton 14 comprise second rear minor flaps 78, second rear inner major flap 80 and second outer major subflap 74 described above.

As can be seen in FIG. 1, panels 38, 36, 34, 20, 18, 23, 26, and 28 are separated from their respective front and rear closure flaps by score lines 86 and 88 which extend parallel to the longitudinal axis of the blank. Panels 38, 36, 34, 20, 16, 23, 26, and 28 are separated from each other respectively by transverse score lines 90, 92, 94, 96, 98 and 100. First glue flap 30 is separated from first medial side panel 28 by transverse score line 102 and second glue flap 40 is separated from second medial side panel 38 by transverse score line 104.

Preferably, front first and second inner major closure panels 48 and 58 include delamination windows 110 and 112 respectively. By delamination window, it is meant that a padial cut score line, such as lines 114 and 116 form at least three sides of a window. A fourth side may be provided by a free edge of a flap, as illustrated. Alternatively, the fourth side of the window may be provided by another partially cut score line.

Preferably, the delamination window does not include a straight line parallel to the score line or fold line 86. This is significant in that where such straight lines are present, bending of the flap tends to occur, which bending interferes with sealing of the carton. The shape of any cut score lines or other lines of weakness extending parallel to score line 86 can be of various forms. For instance, a sinusoidal undulating partial cut score is illustrated, although other types of borders may be used.

A particularly effective form of deviation from a straight line is a line which contains oscillations such as those found in FIG. 1 in windows 110 and 112, which oscillations are disposed generally in a border of windows 110 and 112 disposed generally parallel to score lines 86. It is believed that the presence of such oscillations improves the resistance of the partially cut score line to folding. Preferably, the wave form includes at least one period, although less than one period may be used. It is especially preferred that the wave form include at least two periods, as is the case for the partially cut lines 114 and 116 of FIG. 1.

The oscillating line may be curved as shown in FIG. 1, but other oscillating waves such as those wherein the peaks and troughs of the curves are connected by straight angles, rather than curves, may be employed.

Curves are preferred wherein the amplitude of oscillation is one percent or greater with respect to the length of the delaminating window as measured from one end to the other of the oscillating line parallel to the score line separating the flap from the carton panel. The length of the delaminating window is taken as a straight line from one end of the oscillating line to the other rather than taken as a length along the curve. It is particularly preferred that the amplitude of oscillation be at least 3 percent of the length of the delaminating window. It is expected that generally higher values will produce improved results.

While the delaminating window is illustrated as being located on the inner major flap, it may equally be located on the outer major flap or both.

Hot melt, glue or other adhesive will preferably be applied such that the delaminating window-containing flap is adhered to an underlying or overlying closure flap substantially only at the delamination window. Preferably substantially the entire delamination window area is glued to the other flap, in FIG. 1 to the overlying sub flaps 52 and 54 respectively. Preferably substantially none of the delamination window-containing flap is glued to the other flap outside of the delamination window area. The hot melt, glue or other chemical or other adhesive may be applied either to the overlying or underlying flap.

The carton is assembled by folding panel 23 perpendicular to panel 16, folding panel 26 underneath subpanel 18 and perpendicular to panel 23, folding panel 28 perpendicular to panel 26 and parallel to panel 23 and folding glue flap 30 and adhering it to the underside of subpanel 18.

Likewise, panel 34 is folded perpendicular to panel 20, panel 36 is folded perpendicular to panel 34 and underneath panel 20, panel 38 is folded perpendicular to panel 36 and parallel to panel 34. Glue flap 40 is folded and adhered to the underside of subpanel 20. First and second rear closure flaps are closed by folding the minor flaps inwardly and perpendicular to their associated panels, after which the inner major flaps 68 and 80 are folded parallel to their respective panels 26 and 36. Adhesive is applied to the outer surface of inner major flaps 68 and 80 and/or to the inner surface of subflaps 72 and 74 so as to seal the rear of the canon closed.

The front flaps are closed and sealed in the same manner as the rear flaps, except that care is taken to ensure that adhesive is placed so as to bond the flaps 48 and 58 to subflaps 52 and 54 substantially only in the area of the delamination window. The carton may be produced without the use of hot sealing gases.

Figure 3:
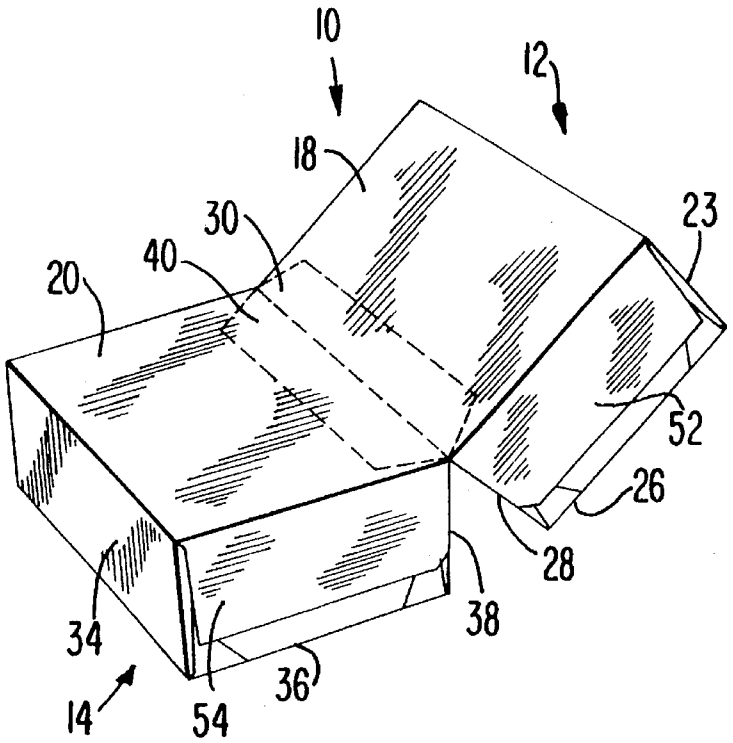
FIG. 3 is a perspective view of the erected package of the invention wherein the front major sub-flaps have been separated from each other and the cartons partially separated.
Figure 2:
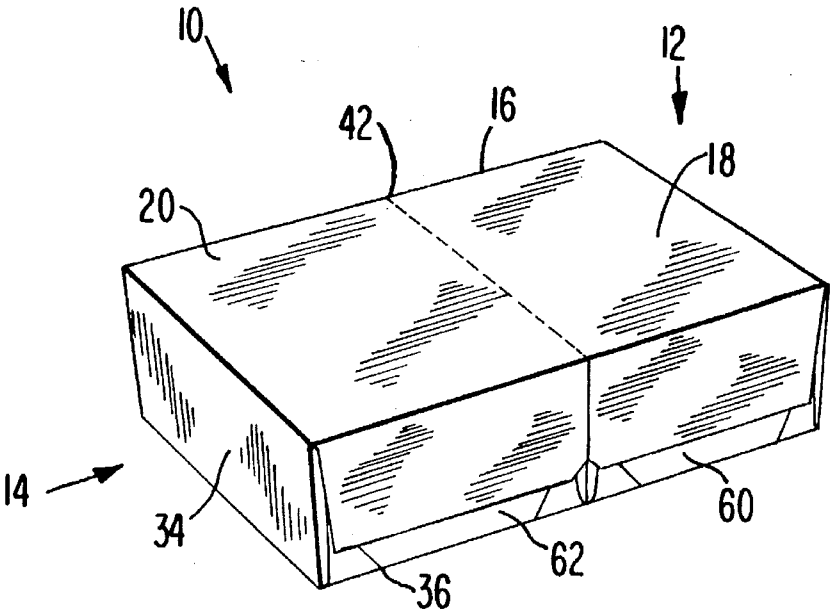
FIG. 2 is a perspective view of erected package of the invention.
Figure 4:
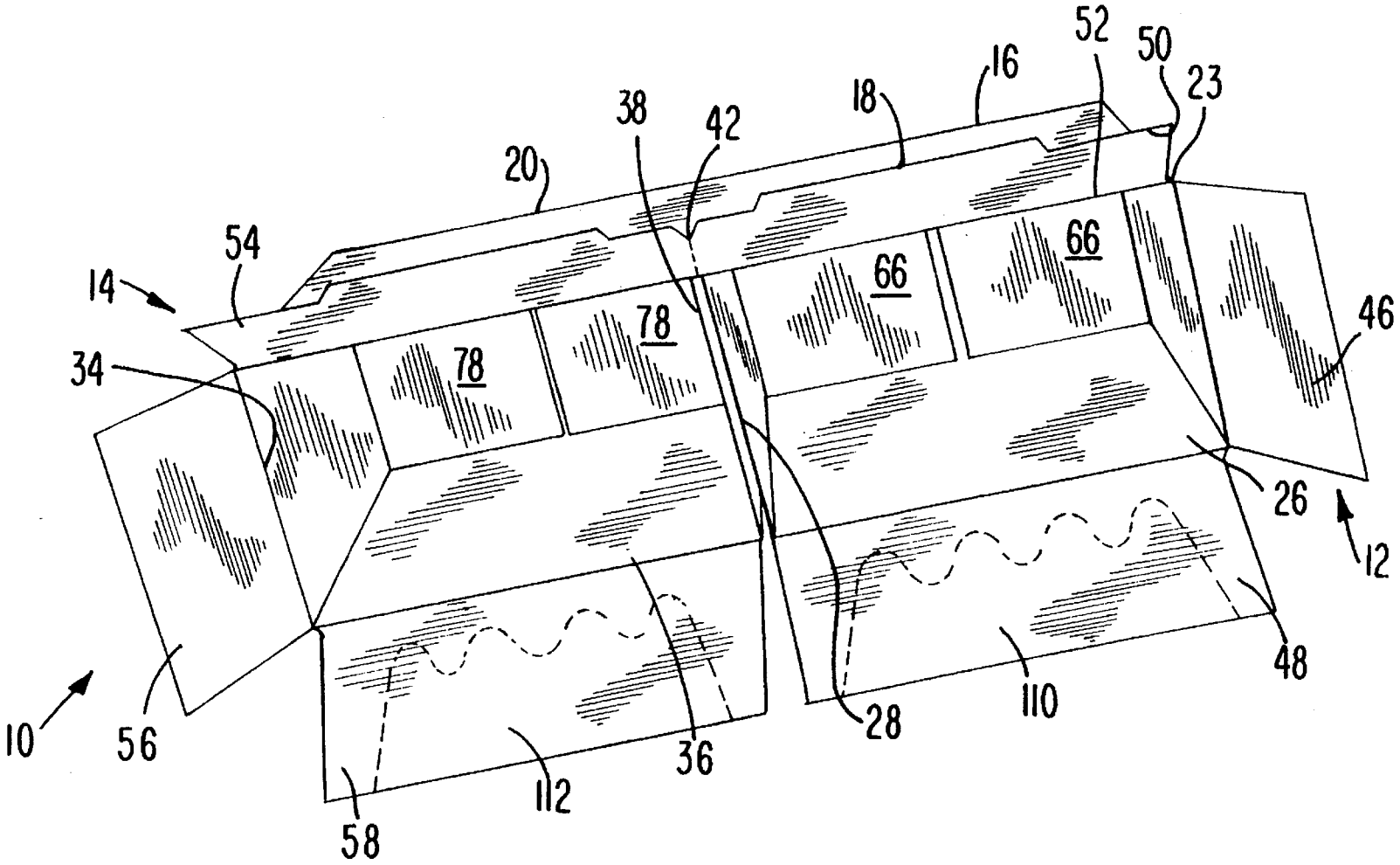
FIG. 4 is a perspective view of the erected package of the invention but with one set of closing flaps open.

In operation, the consumer is presented with a package resembling that of FIG. 2. The consumer may separate the canons of the package by tearing perforated line 42 separating front closure sub flaps 52 and 54, as seen in FIG. 3. Simultaneously, the portion of perforated line 42 dividing subpanel 72 and 74 will be separated in the rear of the package. If the consumer desires, he or she may also separate the portion of perforated line 42 which divides top panel 16, thereby completely separating the canons.

In opening the canons, the consumer may utilize lift tabs 60 and/or 62. In addition, when he or she grasps the front closure flap 52 and/or 54, since the underlying flap is bonded to the overlying flap in the glued delamination window, the delamination window will delaminate and the canon is readily opened.

If desired one or more of flaps 50 and 70 may be formed of separate flaps instead of separable sub flaps.

The carton may be made of paperboard, coated paperboard, or other appropriate material. Hot melt or chemical adhesive such as glue may be used to adhere portions of the carton together. An appropriate coating would be a low density polyethylene extrusion coating.

Hot sealing gases need not and preferably are not employed.

Figure 5:
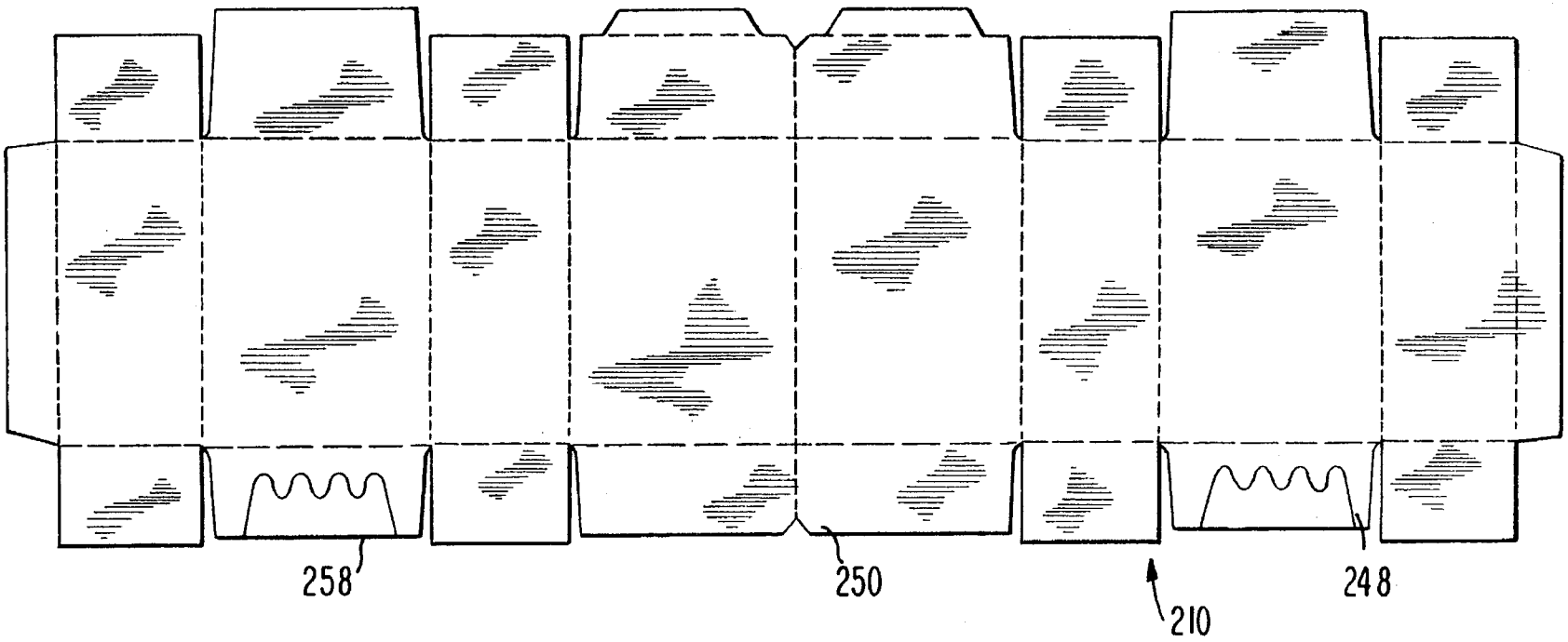
FIG. 5 shows a blank similar to that of FIG. 1 but having shied flaps.

If desired the major and/or minor flaps may be shied. That is, their length in the direction facing the opposing flap is shortened to conserve paperboard. In FIG. 5, blank 210 includes shied flaps 248, 250 and 258. Likewise the front major flaps and all the minor flaps may comprise shied flaps.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A package comprising at least two detachable cartons formed from an integral blank and separated by a line of weakness wherein the package includes a top panel divided by said line of weakness into adjacent first and second top subpanels, a first lateral side panel adjacent to said first top subpanel, a first bottom panel adjacent to said first lateral side panel and opposite said first top subpanel, and a first medial side panel between said first top subpanel and said first bottom panel and opposite said first lateral side panel, a first glue flap extending from said first medial side panel and adhered to said first top subpanel, a second lateral side panel adjacent said second top subpanel, a second bottom panel adjacent to said second lateral side panel and opposite said second top subpanel, and a second medial side panel between said second top subpanel and said second bottom panel and opposite said second lateral side panel, a second glue flap extending from said second medial side panel and adhered to said second top subpanel, each of said cartons including front closing flaps, said front closing flaps comprising a top subpanel major closure flap attached to at least one of said top subpanels by a fold line and a bottom panel major closure flap attached to at least one of said first or second bottom panels by a fold line, one of said top subpanel or bottom major closure flaps including a delamination window formed by partial cuts in its surface facing the other of said major closure flaps, said partial cuts not forming a straight line in a direction generally parallel to said fold line separating said delamination window-containing flap from said panels.

2. The package according to claim 1 wherein said window-including flap comprises side edges on either side of said window flap-separating fold line, said delamination window not encompassing said side edges.

3. The package according to claim 1 wherein said line of weakness is a perforated line.

4. The package according to claim 1 wherein adhesive means is provided to adhere said window-containing flap to the other major flap within said delamination window and not outside said delamination window.

5. The package according to claim 1 wherein said delamination window includes a border generally parallel to the fold line separating the delamination window-containing flap from the panel and said border contains an oscillation.

6. The package according to claim 1 further comprising side flaps disposed between said major flaps, said side flaps being free of lateral attachment to said delamination window-containing flap.

7. The package of claim 1 wherein said border forms an undulating curve in a direction parallel to the fold line.

8. The package according to claim 5 wherein said oscillation includes at least one period.

9. The package of claim 8 wherein the amplitude of the oscillation is at least 1% or greater with respect to the length of the delaminating window as measured from one end to the other of the oscillating border.

10. The package of claim 1 wherein at least one of said front opening flaps includes a lift tab.

11. A blank for a package having at least two separable cartons and having a longitudinal axis, said blank comprising a top panel divided by a line of weakness extending transversely to said longitudinal axis into adjacent first and second top subpanels, a first proximal side panel adjacent to said first top subpanel on a side opposite said second top subpanel and separated from said first top subpanel by a first proximal transverse scoreline, a first bottom panel adjacent to said first proximal side panel on a side opposite said first top subpanel and separated from said first proximal side panel by a first intermediate transverse scoreline, a first distal side panel adjacent said first bottom panel on a side opposite said first proximal side panel and separated therefrom by a first distal transverse scoreline, a first glue flap extending from said first distal side panel on a side opposite said first bottom panel and separated from said first distal side panel by a first transverse glue flap scoreline, a second proximal side panel adjacent to said second top subpanel on a side opposite said first top subpanel and separated therefrom by a second proximal transverse scoreline, a second bottom panel adjacent to said second proximal side panel on a side opposite said second top subpanel and separated from said second proximal side panel by a second intermediate transverse scoreline, a second distal side panel adjacent said second bottom panel on a side opposite said second proximal side panel and separated from said second bottom panel by a second distal transverse scoreline, a second glue flap extending from said second distal side panel and separated therefrom by a second transverse glue flap scoreline, a front top panel major closure flap attached to at least one of said top subpanels by a fold line and a bottom panel major closure flap attached to at least one of said first or second bottom panels by a fold line, one of said major closure flaps including a delamination window formed by partial cuts in its surface disposed to face the other of said major flaps when the carton is erected, said partial cuts not forming a straight line in a direction generally parallel to said fold line separating said delamination window-containing flap from said panel.

12. The package blank according to claim 11 wherein said blank includes top and bottom closure flaps on each of said top, first and second proximal side, first and second bottom and first and second distal side panels, separated from their respective panels by the longitudinal scorelines.

13. The package blank according to claim 12 wherein said top panel and bottom panel closure flaps are each divided by lines of weakness into first and second subflaps.

14. The package blank according to claim 13 wherein said lines of weakness dividing said flaps into subflaps are collinear with said line of weakness dividing said top panel into first and second top subpanels.

15. A process of making a package from the carton blank of claim 11 comprising applying adhesive to at least one said major closing flaps so that bonding will occur between the two flaps at the delamination window and not outside of the delamination window.

16. The process of claim 15 wherein no hot gases are applied in sealing the carton.

* * * * *